US009912126B2

(12) United States Patent
Fujimura et al.

(10) Patent No.: US 9,912,126 B2
(45) Date of Patent: Mar. 6, 2018

(54) SPARK PLUG INSULATOR CONTAINING MULLITE AND SPARK PLUG INCLUDING SAME

(71) Applicant: NGK SPARK PLUG CO., LTD., Nagoya-shi, Aichi (JP)

(72) Inventors: Kengo Fujimura, Ichinomiya (JP); Toshitaka Honda, Nagoya (JP); Hirokazu Kurono, Nagoya (JP); Ryuji Nagae, Hioki (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/507,893

(22) PCT Filed: Jul. 23, 2015

(86) PCT No.: PCT/JP2015/003685
§ 371 (c)(1),
(2) Date: Mar. 1, 2017

(87) PCT Pub. No.: WO2016/038776
PCT Pub. Date: Mar. 17, 2016

(65) Prior Publication Data

US 2017/0256917 A1 Sep. 7, 2017

(30) Foreign Application Priority Data

Sep. 12, 2014 (JP) ..... 2014-186843

(51) Int. Cl.
*H01T 13/38* (2006.01)
*H01B 3/12* (2006.01)
(Continued)

(52) U.S. Cl.
CPC ..... *H01T 13/38* (2013.01); *H01B 3/12* (2013.01); *H01B 17/58* (2013.01); *H01T 13/32* (2013.01); *H01T 21/02* (2013.01)

(58) Field of Classification Search
CPC ..... H01T 13/38; H01T 13/32; H01T 21/02; H01B 17/58; H01B 3/12
See application file for complete search history.

(56) References Cited

U.S. PATENT DOCUMENTS 9,362,722 B2 * 6/2016 Takaoka ..... H01T 13/38
2010/0229813 A1 * 9/2010 Ogata ..... C04B 35/111 123/146.5 R

FOREIGN PATENT DOCUMENTS

JP H03-226982 A 10/1991
JP 2001-002465 A 1/2001
(Continued)

OTHER PUBLICATIONS

Japan Patent Office, International Search Report issued in corresponding Application No. PCT/JP2015/0003685, dated Sep. 29, 2015.
(Continued)

*Primary Examiner* — Tracie Y Green
(74) *Attorney, Agent, or Firm* — Stites & Harbison, PLLC; Jeffrey A. Haeberlin; James R. Hayne

(57) ABSTRACT

An insulator is rendered less breakable. A spark plug insulator is a tube-shaped spark plug insulator having a through hole extending in a direction of an axial line. The spark plug insulator contains alumina as a main component and mullite at at least part of the insulator. Mullite is contained in only an inner circumferential surface of the tube-shaped spark plug insulator and in at least part of the inner circumferential
(Continued)

surface of the spark plug insulator in an area extending toward a distal end from a portion having a largest outer diameter.

5 Claims, 8 Drawing Sheets

(51) Int. Cl.

| | |
|---|---|
| ***H01T 13/32*** | (2006.01) |
| ***H01B 17/58*** | (2006.01) |
| *H01T 21/02* | (2006.01) |

(56) References Cited

FOREIGN PATENT DOCUMENTS

| | | | |
|---|---|---|---|
| JP | 2002-246144 | A | 8/2002 |
| JP | 2009-242234 | A | 10/2009 |
| JP | 2011-154908 | A | 8/2011 |
| JP | 2013-187049 | A | 9/2013 |

OTHER PUBLICATIONS

Japan Patent Office, Written Opinion issued in corresponding Application No. PCT/JP2015/0003685, dated Sep. 29, 2015 (English translation unavailable).

* cited by examiner

SPARK PLUG INSULATOR CONTAINING MULLITE AND SPARK PLUG INCLUDING SAME

TECHNICAL FIELD

The present invention relates to a spark plug insulator.

BACKGROUND ART

Spark plugs have been used to ignite, for example, the fuel-air mixture in the combustion chamber of an internal combustion engine. A spark plug includes, for example, a central electrode and a ground electrode and ignites the fuel-air mixture by spark discharge caused in a gap between the central electrode and the ground electrode. A spark plug includes an insulator that insulates the central electrode and the ground electrode with each other. An example of such an insulator is made of a material containing alumina.

CITATION LIST

Patent Literature

PTL 1: Japanese Unexamined Patent Application Publication No. 2002-246144
PTL 2: Japanese Unexamined Patent Application Publication No. 2011-154908
PTL 3: Japanese Unexamined Patent Application Publication No. 2001-2465
PTL 4: Japanese Unexamined Patent Application Publication No. 2009-242234

SUMMARY OF INVENTION

Technical Problem

In view of performance improvement (such as enhancement of fuel efficiency), various types of internal combustion engines have been developed in these years. Spark plugs that produce further improved performance (such as a plug having a less breakable insulator) have been increasingly desired with progressing development of internal combustion engines. Rendering insulators less breakable, however, is difficult.

A main advantage of the present invention is to render an insulator less breakable.

Solution to Problem

The present invention was made to solve at least part of the above problem. The present invention is capable of being embodied in the following application examples.

Application Example 1

A tube-shaped spark plug insulator has a through hole extending in a direction of an axial line, and the spark plug insulator contains alumina, as a main component, and mullite, at at least part of the spark plug insulator. In the plug, the mullite is contained in only an inner circumferential surface of the tube-shaped spark plug insulator and in at least part of the inner circumferential surface of the spark plug insulator in an area extending toward a distal end from a portion having a largest outer diameter.

In this configuration, at least part of the inner circumferential surface in an area extending toward the distal end from a portion having the largest outer diameter contains mullite, having a coefficient of thermal expansion smaller than that of alumina. This configuration can thus prevent the through hole of the insulator from contracting due to thermal expansion of the insulator in response to a temperature rise of a distal portion of the insulator. Thus, the insulator is less likely to be broken as a result of the inner circumferential surface of a distal portion of the insulator coming into contact with a member (for example, a central electrode) disposed in the through hole. The outer circumferential surface of the insulator, on the other hand, does not contain mullite but contains alumina, having higher voltage endurance than mullite. When insulators have the same thickness, the insulator having the above-described configuration can thus produce higher voltage endurance performance than the insulator in which mullite is contained in both the inner circumferential surface and the outer circumferential surface. Thus, the insulator is rendered less breakable without impairing its voltage endurance.

Application Example 2

The spark plug insulator described in application example 1 includes a uniform-diameter portion, having a uniform inner diameter and extending from a distal end of the spark plug insulator in the direction of the axial line on an inner circumference in the area extending toward the distal end from the portion having the largest outer diameter. In the plug, at least part of an inner circumferential surface of the uniform-diameter portion contains mullite.

This configuration can prevent a through hole from contracting due to thermal expansion of the insulator at a uniform-diameter portion, which is a distal portion of the insulator at which the temperature is likely to rise easily. Thus, the insulator is rendered less breakable as a result of the inner circumferential surface of the spark plug insulator at the uniform-diameter portion coming into contact with a member disposed in the through hole.

Application Example 3

In the spark plug insulator described in application example 1, the insulator includes a chamfered portion at which an inner diameter of the insulator decreases toward a proximal end, the chamfered portion being disposed at a distal portion of the insulator on an inner circumference of the insulator. At least part of an inner circumferential surface in an area extending toward the proximal end from the chamfered portion contains mullite.

In this configuration, the insulator is rendered less breakable as a result of the inner circumferential surface of the spark plug insulator in an area extending toward the proximal end from the chamfered portion coming into contact with a member disposed in the through hole.

Application Example 4

In the spark plug insulator described in any one of application examples 1 to 3, at least part of an inner circumferential surface in a distal half of the area extending toward the distal end from the portion having the largest outer diameter contains mullite.

The distal half of the area extending toward the distal end from a portion having the largest outer diameter is more likely to have a higher temperature than the proximal half. In this configuration, the insulator is less likely to be broken as a result of the inner circumferential surface of the spark plug insulator in the distal half, the temperature of which is likely to rise easily, coming into contact with a member disposed in the through hole.

Application Example 5

A spark plug includes the spark plug insulator according to any one of application examples 1 to 4, a central electrode disposed in a distal portion of the through hole, a metal shell disposed around the insulator, and a ground electrode joined to the metal shell and facing a distal portion of the central electrode with a gap interposed therebetween.

The present invention can be embodied in various different forms including, for example, a spark plug insulator, a spark plug including the insulator, and an internal combustion engine in which the spark plug is installed.

DESCRIPTION OF EMBODIMENTS

A. First Embodiment

Figure 1:
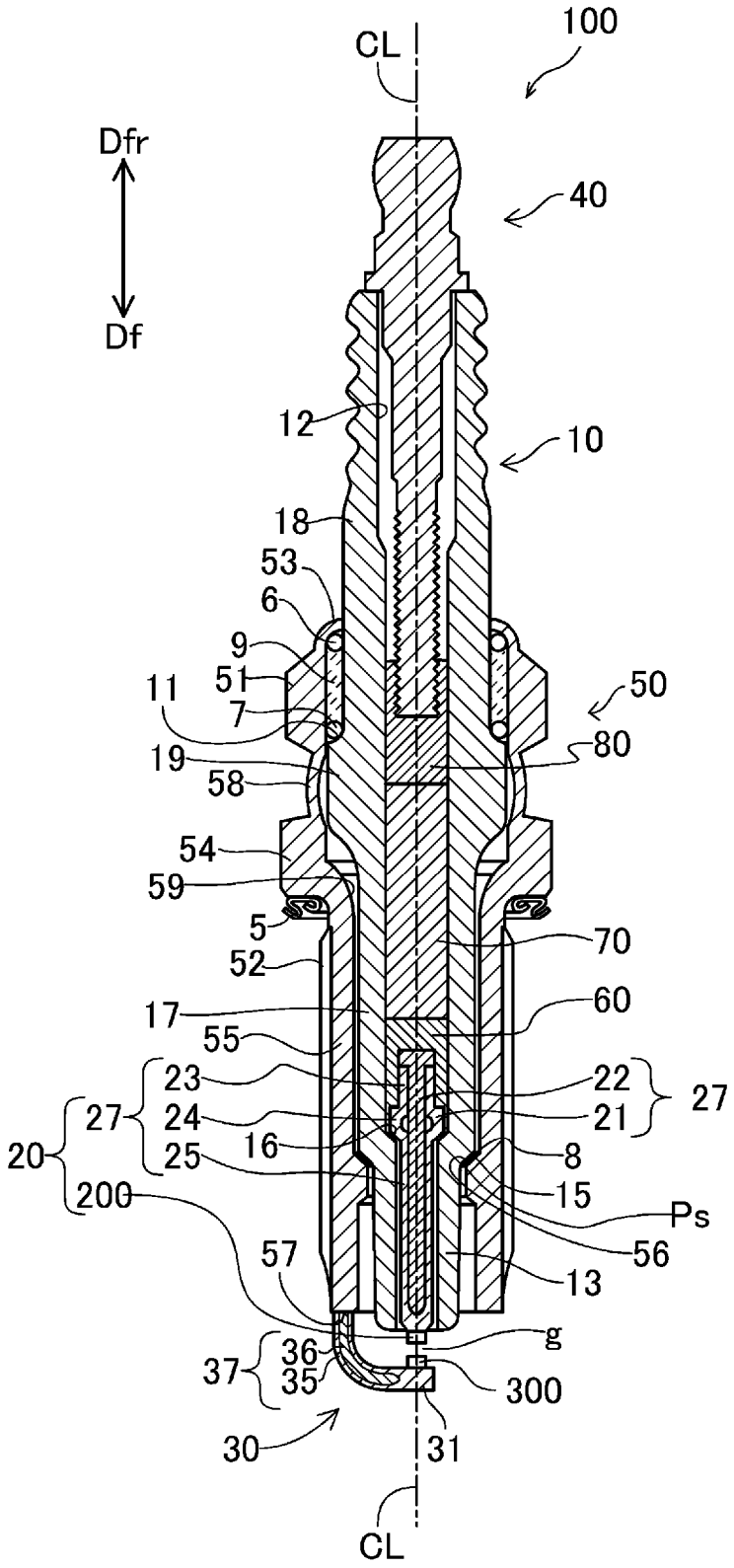
FIG. 1 is a sectional view of a spark plug according to an embodiment.

FIG. 1 is a sectional view of a spark plug according to an embodiment. FIG. 1 illustrates a central axis CL (also referred to as "an axial line CL") of a spark plug 100. The section illustrated is a section including the central axis CL. Hereinbelow, the direction parallel to the central axis CL is referred to as "a direction of the axial line CL" or, simply, "an axial line direction". A direction of the radius of a circle having the central axis CL at the center is also simply referred to as "a radial direction" and a direction of the circumference of a circle having the central axis CL at the center is also referred to as "a circumferential direction". Among directions parallel to the central axis CL, the downward direction in FIG. 1 is referred to as a distal direction Df and the upward direction in FIG. 1 is referred to as a proximal direction Dfr. The distal direction Df is directed from a metal terminal 40, described below, toward terminals 20 and 30. The area extending toward the end in the distal direction Df in FIG. 1 is referred to as an area extending toward a distal end of the spark plug 100 and the area extending toward the end in the proximal direction Dfr in FIG. 1 is referred to as an area extending toward a proximal end of the spark plug 100.

The spark plug 100 includes an insulator 10 (also referred to as "a ceramic insulator 10"), a central electrode 20, a ground electrode 30, a metal terminal 40, a metal shell 50, an electrically conductive first sealant 60, a resistor 70, an electrically conductive second sealant 80, a distal gasket 8, a talc 9, a first proximal gasket 6, and a second proximal gasket 7.

The insulator 10 is a substantially cylindrical-tube-shaped member extending along the central axis CL and having a through hole 12 (also referred to as "an axial hole 12", below) extending through the insulator 10. The insulator 10 is formed by firing a material containing alumina (the details are described below). The insulator 10 includes a leg portion 13, a first tapered outer-diameter portion 15, a distal trunk portion 17, a flange portion 19, a second tapered outer-diameter portion 11, and a proximal trunk portion 18, which are arranged in order from the distal end toward the proximal direction Dfr. The flange portion 19 is a portion of the insulator 10 having the largest outer diameter. The outer diameter of the first tapered outer-diameter portion 15 gradually decreases from the proximal end toward the distal end. A tapered inner-diameter portion 16 having an inner diameter gradually decreasing from the proximal end toward the distal end is disposed at a portion of the insulator 10 adjacent to the first tapered outer-diameter portion 15 (in the distal trunk portion 17 in the example illustrated in FIG. 1). The outer diameter of the second tapered outer-diameter portion 11 gradually decreases from the distal end toward the proximal end.

The central electrode 20 is inserted into a distal portion of the axial hole 12 of the insulator 10. The central electrode 20 includes a stick-shaped shank portion 27, extending along the central axis CL, and a first tip 200, joined to the distal end of the shank portion 27. The shank portion 27 includes a leg portion 25, a flange portion 24, and a head portion 23, which are arranged in order from the distal end toward the proximal direction Dfr. A first tip 200 is joined to the distal end of the leg portion 25 (that is, the distal end of the shank portion 27) by, for example, laser welding. At least part of the first tip 200 in an area extending toward the distal end from the insulator 10 is exposed to the outside from the axial hole 12. The surface of the flange portion 24 facing in the distal direction Df is supported by the tapered inner-diameter portion 16 of the insulator 10. The shank portion 27 also includes an outer layer 21 and a core portion 22. The outer layer 21 is made of a material (such as pure nickel or an alloy containing nickel and chromium) having oxidation resistance higher than that of the core portion 22, that is, a material that is consumed to a lesser extent when exposed to combustion gas inside the combustion chamber of an internal combustion engine. The core portion 22 is made of a material (such as pure copper or a copper alloy) having higher thermal conductivity than that of the outer layer 21. The proximal end portion of the core portion 22 is exposed from the outer layer 21 to function as a proximal end portion of the central electrode 20. The other portion of the core portion 22 is covered with the outer layer 21. However, the entirety of the core portion 22 may be covered with the outer layer 21. The first tip 200 is made of a material (for example, a noble metal such as iridium (Ir) or platinum (Pt), tungsten (W), or an alloy containing at least one selected from these metals) having higher discharge endurance than that of the shank portion 27.

Part of the metal terminal 40 is inserted into a proximal portion of the axial hole 12 of the insulator 10. The metal terminal 40 is made of an electrically conductive material (for example, a metal such as a low-carbon steel).

Inside the axial hole 12 of the insulator 10, a substantially cylindrical resistor 70 that reduces an electric noise is disposed between the metal terminal 40 and the central electrode 20. The resistor 70 is made of, for example, a material containing an electrically conductive material (such as carbon particles), ceramic particles (such as $ZrO_2$), and glass particles (such as $SiO_2$—$B_2O_3$—$Li_2O$—BaO glass particles). The electrically conductive first sealant 60 is disposed between the resistor 70 and the central electrode 20. The electrically conductive second sealant 80 is disposed between the resistor 70 and the metal terminal 40. The sealants 60 and 80 are made of a material containing, for example, metal particles (such as Cu) and glass particles the same as those contained in the material of the resistor 70. The central electrode 20 and the metal terminal 40 are electrically connected to each other with the resistor 70 and the sealants 60 and 80 interposed therebetween.

The metal shell 50 is a substantially cylindrical-tube-shaped member extending along the central axis CL and having a through hole 59 that extends through the metal shell 50. The metal shell 50 is made of a low-carbon steel (other electrically conductive materials, such as another metal material, are also usable). The insulator 10 is inserted into the through hole 59 of the metal shell 50. The metal shell 50 is fixed to the outer circumference of the insulator 10. The distal end of the insulator 10 (distal portion of the leg portion 13 in this embodiment) in a distal area of the metal shell 50 is exposed to the outside of the through hole 59. The proximal end of the insulator 10 (proximal portion of the proximal trunk portion 18 in this embodiment) in a proximal area of the metal shell 50 is exposed to the outside from the through hole 59.

The metal shell 50 includes a trunk portion 55, a seat portion 54, a deformed portion 58, a tool fastening portion 51, and a crimped portion 53, which are arranged in order from the distal end toward the proximal end. The seat portion 54 is a flange-shaped portion. The trunk portion 55 is an approximately cylindrical-tube-shaped portion extending from the seat portion 54 in the distal direction Df along the central axis CL. A thread 52 is formed on the outer circumferential surface of the trunk portion 55 so as to be screwable on an attachment hole of an internal combustion engine. An annular gasket 5, formed by bending a metal plate, is fitted into a space between the seat portion 54 and the thread 52.

The metal shell 50 includes a tapered inner-diameter portion 56 disposed in an area extending toward the end in the distal direction Df from the deformed portion 58. The inner diameter of the tapered inner-diameter portion 56 gradually decreases from the proximal end toward the distal end. The distal gasket 8 is interposed between the tapered inner-diameter portion 56 of the metal shell 50 and the first tapered outer-diameter portion 15 of the insulator 10. The distal gasket 8 is an O-shaped ring made of iron (other materials, for example, a metal material such as copper, are also usable). The distal gasket 8 seals a junction between the metal shell 50 and the insulator 10.

The tool fastening portion 51 is a portion at which a tool for tightening the spark plug 100 (such as a spark plug wrench) is fastened. In this embodiment, the tool fastening portion 51 has an external appearance of a substantially hexagonal prism extending along the central axis CL. The crimped portion 53 is disposed on the proximal side of the second tapered outer-diameter portion 11 of the insulator 10 to function as a proximal end of the metal shell 50 (that is, the end in the proximal direction Dfr). The crimped portion 53 is bent toward the inner side in the radial direction. In the area extending from the crimped portion 53 in the distal direction Df, the first proximal gasket 6, the talc 9, and the second proximal gasket 7 are arranged in this order in the distal direction Df between the inner circumferential surface of the metal shell 50 and the outer circumferential surface of the insulator 10. In this embodiment, these proximal gaskets 6 and 7 are C-shaped rings made of iron (other materials are also usable).

In manufacturing of the spark plug 100, the crimped portion 53 is crimped so as to be bent inward. The crimped portion 53 is then pressed in the distal direction Df. Thus, the deformed portion 58 is deformed and the insulator 10 is pressed toward the distal end inside the metal shell 50 with the gaskets 6 and 7 and the talc 9 interposed therebetween. The distal gasket 8 is squeezed between the first tapered outer-diameter portion 15 and the tapered inner-diameter portion 56 to seal between the metal shell 50 and the insulator 10. Thus, the metal shell 50 is fixed to the insulator 10.

In this embodiment, the ground electrode 30 includes a stick-shaped shank portion 37 and a second tip 300 joined to a distal portion 31 of the shank portion 37. The proximal end of the shank portion 37 is joined to a distal surface 57 (that is, a surface 57 facing in the distal direction Df) of the metal shell 50 (by, for example, resistance welding). The shank portion 37 extends from the distal surface 57 of the metal shell 50 in the distal direction Df and is bent toward the central axis CL at the distal portion 31. The distal portion 31 is disposed at a portion located in the distal direction Df from the central electrode 20. The second tip 300 is joined (for example, by laser welding) on the surface of the distal portion 31 facing the central electrode 20. The second tip 300 is made of a material having higher discharge endurance than that of the shank portion 37 (for example, a noble metal such as iridium (Ir) or platinum (Pt), tungsten (W), or an alloy containing at least one selected from these metals). The first tip 200 of the central electrode 20 and the second tip 300 of the ground electrode 30 define a gap g for spark discharge. The ground electrode 30 and the distal portion of the central electrode 20 face each other while having the gap g between each other.

The shank portion 37 of the ground electrode 30 includes an outer layer 35, forming at least part of the surface of the shank portion 37, and a core portion 36, covered with the outer layer 35. The outer layer 35 is made of a material having high oxidation resistance (such as an alloy containing nickel and chromium). The core portion 36 is made of a material (such as pure copper) having higher thermal conductivity than that of the outer layer 35.

Figure 2:
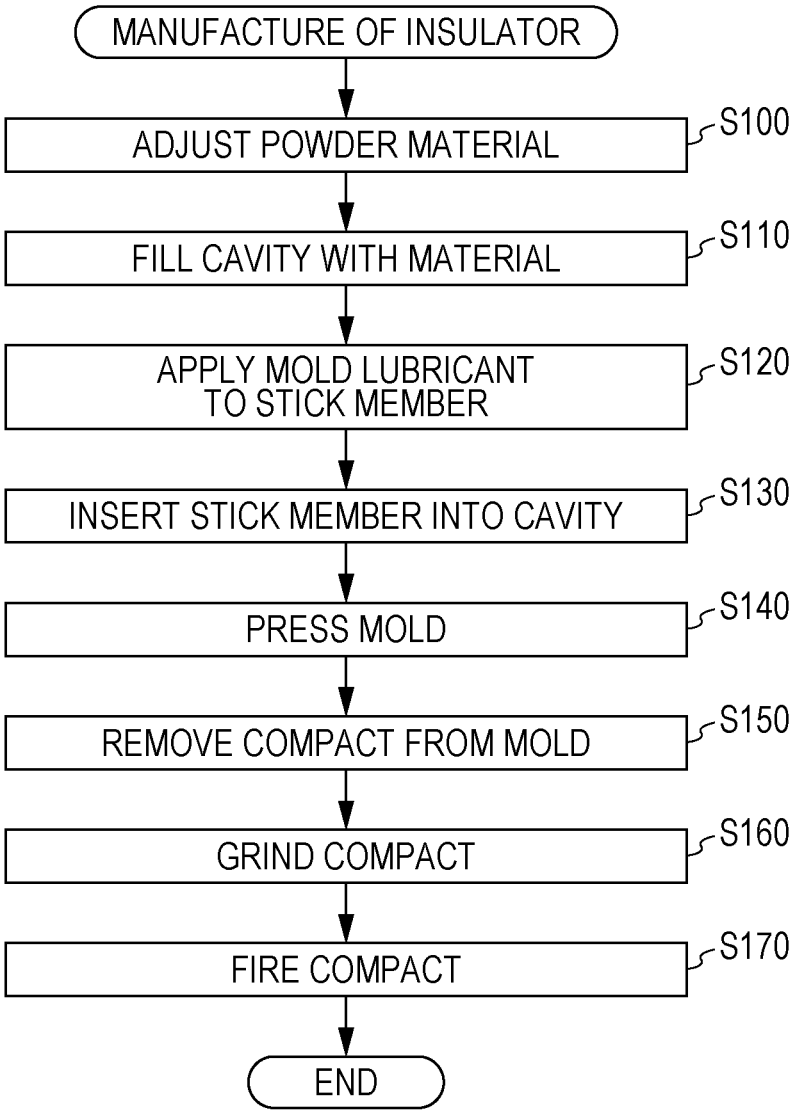
FIG. 2 is a flowchart showing an example of a method for manufacturing an insulator 10.

FIG. 2 is a flowchart of an example of a method for manufacturing the insulator 10. With the manufacturing method illustrated in FIG. 2, an unfired compact is shaped using a mold and the compact is fired to manufacture the insulator 10 (FIG. 1).

In step S100, a powder material of a compact is prepared. In this embodiment, an acrylic binder is added to powder containing alumina (aluminium oxide) powder, as a main component, and a sintering agent. The mixture is then subjected to wet blending using water as a solvent to prepare slurry. The prepared slurry is spray dried to obtain the powder material.

Figure 3:
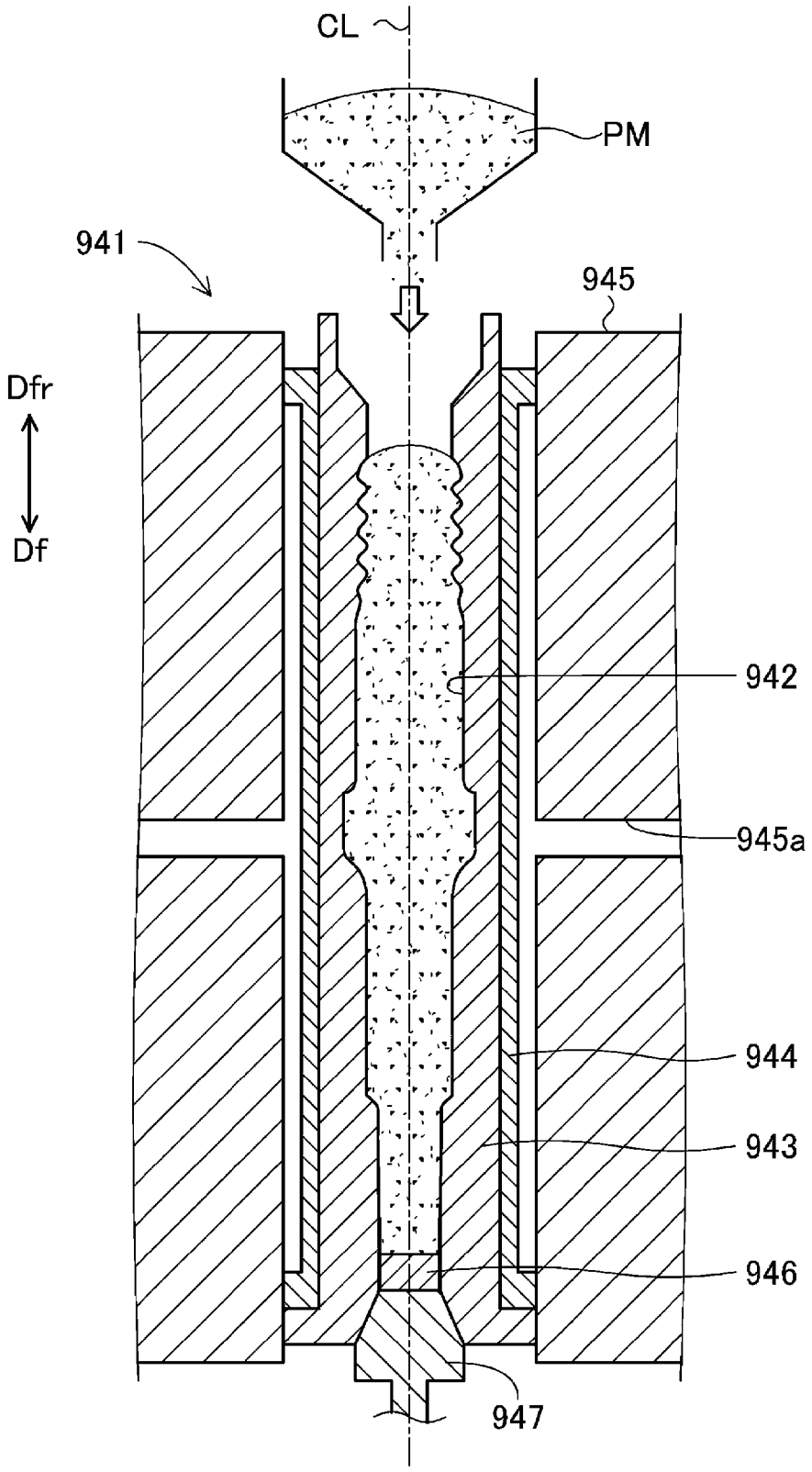
FIG. 3 is a sectional view of an example of a molding press.

Next, in step S110, the cavity of a molding press is filled with the powder material. FIG. 3 is a sectional view of an example of the molding press. FIG. 3 shows the central axis CL and the directions Df and Dfr. The central axis CL and the directions Df and Dfr in FIG. 3 are the central axis and the directions of a compact formed by a member (molding press 941, here) used for molding to which the central axis CL and the directions Df and Dfr of a finished insulator 10 correspond. The central axis CL and the directions Df and Dfr illustrated in FIG. 4 to FIG. 7, described below, are also the central axis and the directions to which the central axis and the directions correspond. The section illustrated in FIG. 3 is a section taken along the plane including the central axis CL.

In this embodiment, a molding press 941 is a rubber press machine. The molding press 941 includes a cylindrical inner rubber mold 943, having a cavity 942 extending along the axial line CL, a cylindrical outer rubber mold 944, disposed on the outer circumference of the inner rubber mold 943, a molding press body 945, disposed on the outer circumference of the outer rubber mold 944, and a bottom cover 946 and a lower holder 947, which close a lower opening of the cavity 942 (lower corresponds to toward the end in the distal direction Df, here). The molding press body 945 includes a liquid flow path 945*a*. The cavity 942 can be radially contracted as a result of radially applying a fluid pressure to the outer circumferential surface of the outer rubber mold 944 with the liquid flow path 945*a* interposed therebetween. The cavity 942 of the inner rubber mold 943 of the molding press 941 is filled with a powder material PM.

Figure 4:
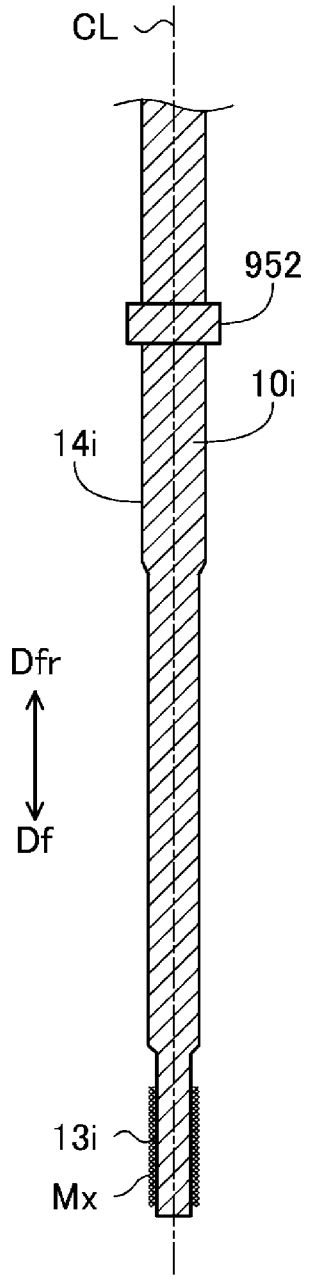
FIG. 4 is a sectional view of a stick member 10*i*.

Next, in step S120 (FIG. 2), a mold lubricant is applied to a stick member 10*i*, which shapes the inner circumferential surface of the through hole 12 of the insulator 10. FIG. 4 is a sectional view of the stick member 10*i* taken along the plane including the central axis CL. An outer circumferential surface 14*i* of the stick member 10*i* is a shaping surface that shapes the inner circumferential surface that defines the through hole 12 of the insulator 10. A mold lubricant (not illustrated) is applied to the outer circumferential surface 14*i*. Here, a mold lubricant Mx containing $S_iO_2$ (silicon dioxide) is applied to a portion 13*i* of the outer circumferential surface 14*i*, the portion 13*i* shaping the inner circumferential surface of the leg portion 13 of the insulator 10. In FIG. 4, the mold lubricant Mx containing $S_iO_2$ is shaded with cross hatching. A mold lubricant not containing $S_iO_2$ is applied to the portion of the outer circumferential surface 14*i* excluding the portion 13*i*. An upper holder 952 is integrally disposed at an end portion of the stick member 10*i* located closer to the end in the proximal direction Dfr.

Figure 5:
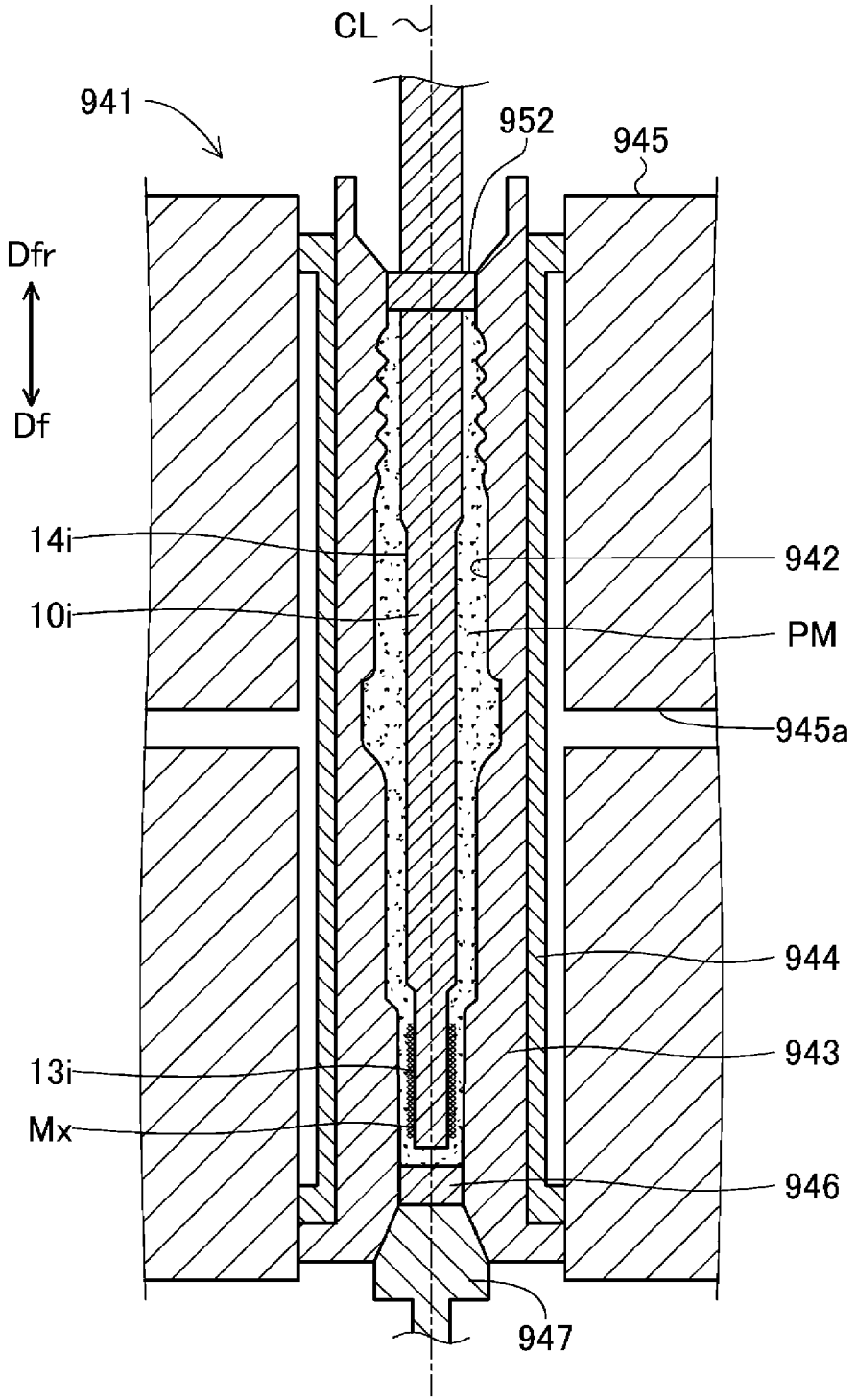
FIG. 5 is a sectional view of the stick member 10*i* disposed inside a cavity 942.

Next, in step S130 (FIG. 2), the stick member 10*i* is placed at a predetermined portion inside the cavity 942. FIG. 5 is a sectional view of the stick member 10*i* disposed inside the cavity 942 of the molding press 941 illustrated in FIG. 3. The upper holder 952 hermetically closes the cavity 942 by being fitted into the upper opening of the cavity 942 (upper corresponds to toward the end in the proximal direction Dfr, here). When the stick member 10*i* is inserted into the cavity 942, the space interposed between the outer circumferential surface 14*i* of the stick member 10*i* and the inner surface of the inner rubber mold 943 is filled with the powder material PM. Here, step S120, in which a mold lubricant is applied to the stick member 10*i*, may be performed at any time before step S130 (for example, between steps S100 and S110 or before step S100). In this embodiment, the stick member 10*i* is inserted into the cavity 942 after the cavity 942 is filled with the powder material PM. However, the method for filling the cavity 942 with the powder material PM is not limited to this. For example, part of the stick member 10*i* may be inserted into the cavity 942 before the cavity 942 is filled with the powder material PM and then the remaining part of the stick member 10*i* may be inserted concurrently with the filling of the cavity 942 with the powder material PM.

Next, in step S140 (FIG. 2), a pressure is exerted from the outer circumference of the inner rubber mold 943 and the outer rubber mold 944 through an application of a fluid pressure with the liquid flow path 945*a* interposed therebetween to contract the cavity 942. Thus, the powder material PM is compressed and shaped. After an elapse of a predetermined time period, the application of the fluid pressure is finished, so that the inner rubber mold 943 and the outer rubber mold 944 are elastically restored and the contracted cavity 942 is restored to its original size.

Figure 6:
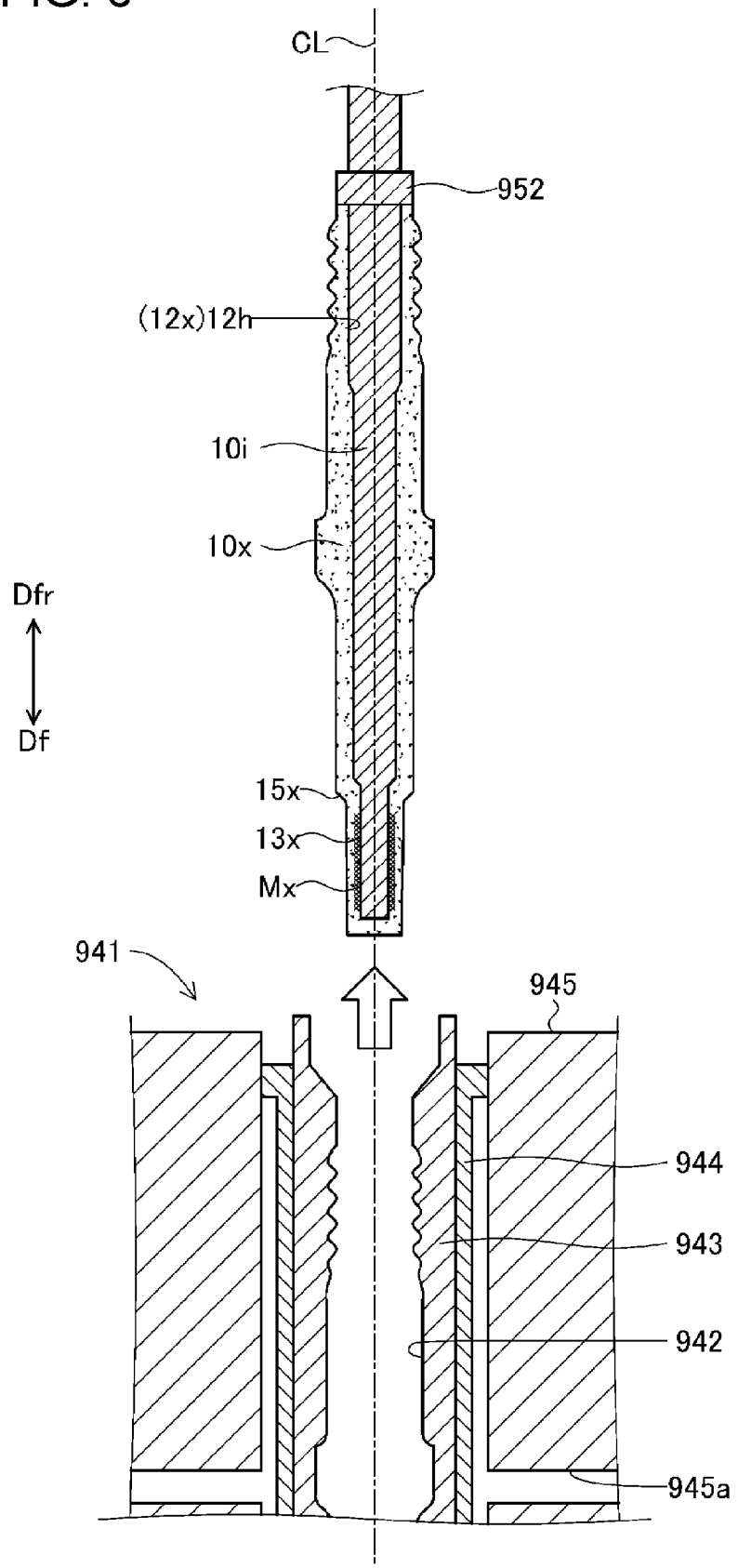
FIG. 6 is a sectional view of a compact 10*x* removed from a molding press 941.

Next, in step S150 (FIG. 2), the shaped compact 10*x* is removed from the molding press 941. FIG. 6 is a sectional view of the compact 10*x* removed from the molding press 941. When the stick member 10*i* is pulled out from the molding press 941 in the proximal direction Dfr along the axial line CL, the compact 10*x* obtained by compressing and shaping the powder material PM is pulled out from the cavity 942 together with the stick member 10*i*. Thereafter, the stick member 10*i* is rotated relative to the compact 10*x*, so that the stick member 10*i* is pulled out from the compact 10*x*.

Next, in step S160 (FIG. 2), the compact 10*x* is ground. In this grinding, the compact 10*x* is processed into a predetermined shape. For example, a portion that covers a hole 12*h*, formed by the stick member 10*i*, and that is located at the end portion in the distal direction Df is ground away to form a through hole 12*x*. The through hole 12*x* of the compact 10*x* corresponds to the through hole 12 of the insulator 10. A portion 13*x* of the compact 10*x* located at an end portion in the distal direction Df corresponds to the leg portion 13 of the insulator 10. The mold lubricant Mx containing $S_iO_2$ adheres to the inner circumferential surface of the portion 13*x* (in FIG. 6, the mold lubricant Mx containing $S_iO_2$ is shaded with cross hatching). A mold lubricant not containing $S_iO_2$ adheres to the other portion of the compact 10*x* (not illustrated).

Next, in step S170 (FIG. 2), the ground compact 10*x* is fired. Thus, the fired insulator 10 is generated. That is, the insulator 10 is complete. The main component of the insulator 10 is alumina. Here, "the main component" means the component having the highest content (in unit of weight percent) (this expression is also applicable, below). Other methods known publically are also usable as the firing method. Alternatively, a glaze may be applied to the surface of a fired component and the component may be finish-fired.

Figure 7:
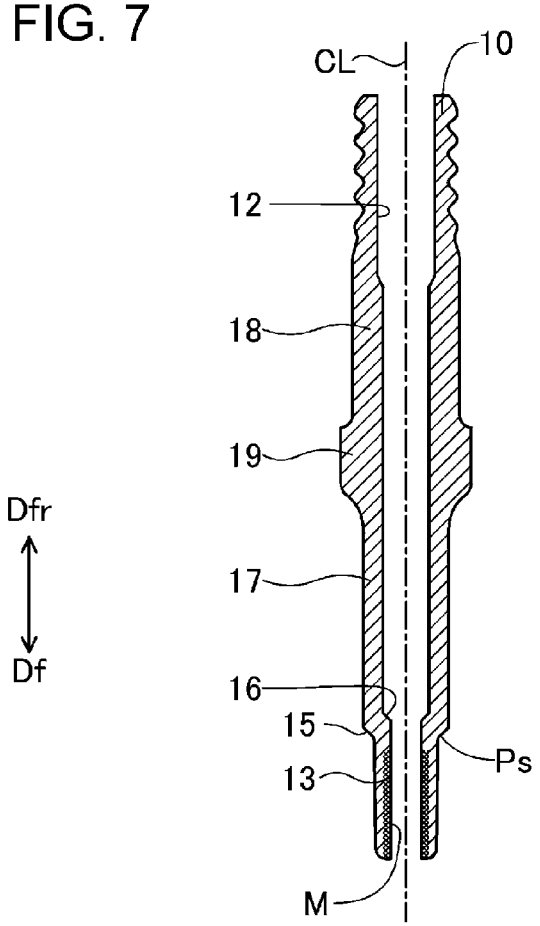
FIG. 7 is a sectional view of a produced insulator 10.

FIG. 7 is a sectional view of the generated insulator 10. A portion M shaded with cross hatching in FIG. 7 is a portion containing mullite ($Al_6O_{13}Si_2$) (the portion is referred to as a mullite portion M). In the embodiment illustrated in FIG. 7, the inner circumferential surface of the leg portion 13 contains mullite. Mullite is generated in the firing in step S170 when alumina ($Al_2O_3$) contained in the material of the compact 10*x* is combined with silicon dioxide ($S_iO_2$) contained in the mold lubricant Mx adhering to the inner circumferential surface of the compact 10*x*. As described above, the mold lubricant Mx containing silicon dioxide adheres to only the inner circumferential surface of the portion 13*i* of the compact 10*x*. Thus, the mullite portion M is formed on only the inner circumferential surface of the leg portion 13.

Mullite contained in the inner circumferential surface is detectable by, for example, X-ray diffraction. When the peak of mullite is detected as a result of a portion forming the inner circumferential surface being subjected to X-ray diffraction measurement, the inner circumferential surface is regarded as containing mullite.

FIG. 1 and FIG. 7 illustrate a sealant distal end position Ps. The sealant distal end position Ps is an end position, in the distal direction Df, of a portion at which the outer circumferential surface of the insulator 10 comes into contact with the distal gasket 8. The distal gasket 8 seals between the insulator 10 and the metal shell 50. The distal gasket 8 prevents high-temperature combustion gas generated inside the combustion chamber of an internal combustion engine from moving in the proximal direction Dfr from the distal gasket 8. A portion of the insulator 10 extending toward the end in the distal direction Df from the sealant distal end position Ps (the leg portion 13, here) is allowed to come into contact with high-temperature combustion gas. Thus, the portion of the insulator 10 extending toward the end in the distal direction Df is more likely to have a higher temperature than the portion of the insulator 10 extending toward the end in the proximal direction Dfr.

When the temperature of the insulator 10 rises, the inner diameter of the insulator 10 (that is, the diameter of the through hole 12) decreases with thermal expansion of the insulator 10. On the other hand, when the temperature of a member disposed inside the through hole 12 (for example, an electrode 20) rises, the outer diameter of the member can be increased due to thermal expansion. Here, if the diameter of the through hole 12 would decrease to a diameter below the outer diameter of a member disposed inside the through hole 12, the insulator 10 could be broken as a result of the inner circumferential surface of the insulator 10 coming into contact with the member disposed inside the through hole 12.

Thus, in this embodiment, the inner circumferential surface of the leg portion 13 contains mullite, as illustrated in FIG. 7. The coefficient of thermal expansion of mullite is smaller than the coefficient of thermal expansion of alumina. Thus, when the inner circumferential surface of the leg portion 13 contains mullite, the inner diameter of the leg portion 13 is prevented from decreasing in a high temperature in contrast to the case where the inner circumferential surface of the leg portion 13 does not contain mullite. The insulator 10 can thus be rendered less likely to be broken as a result of the inner circumferential surface of the leg portion 13 coming into contact with the central electrode 20.

The outer circumferential surface of the insulator 10, on the other hand, does not contain mullite and contains alumina. Alumina has higher voltage endurance than mullite. Having high voltage endurance represents that the insulator 10 is less likely to be broken by high voltage (for example, discharge that penetrates between the inner circumferential surface and the outer circumferential surface of the insulator 10). Thus, provided that insulators 10 have the same thickness at a portion between the inner circumferential surface and the outer circumferential surface, the insulator 10 according to the embodiment can have higher voltage endurance than the insulator in which both of the outer circumferential surface and the inner circumferential surface of the insulator contain mullite.

The insulator 10 according to the embodiment can thus be rendered less breakable without impairing its voltage endurance.

In place of the disposition illustrated in FIG. 7, a portion containing mullite may be disposed in other ways. Typically, mullite is preferably contained in only the inner circumferential surface of the insulator 10 (that is, a portion of the inner circumferential surface excluding the outer circumferential surface). In addition, mullite is preferably contained in a portion of the inner circumferential surface of the insulator 10 in an area extending toward the end in the distal direction Df from a portion having the largest outer diameter (here, the flange portion 19). The portion in the area extending toward the end in the distal direction Df from the portion having the largest outer diameter is more likely to have a higher temperature than the portion in the area extending toward the end in the proximal direction Dfr from the portion having the largest outer diameter. When the inner circumferential surface of such a portion contains mullite, the insulator 10 is rendered less breakable without impairing its voltage endurance. For example, the inner circumferential surface of the distal trunk portion 17 may contain mullite. Alternatively, only part of the inner circumferential surface of the leg portion 13 may contain mullite.

B. Second Embodiment

Figure 8:
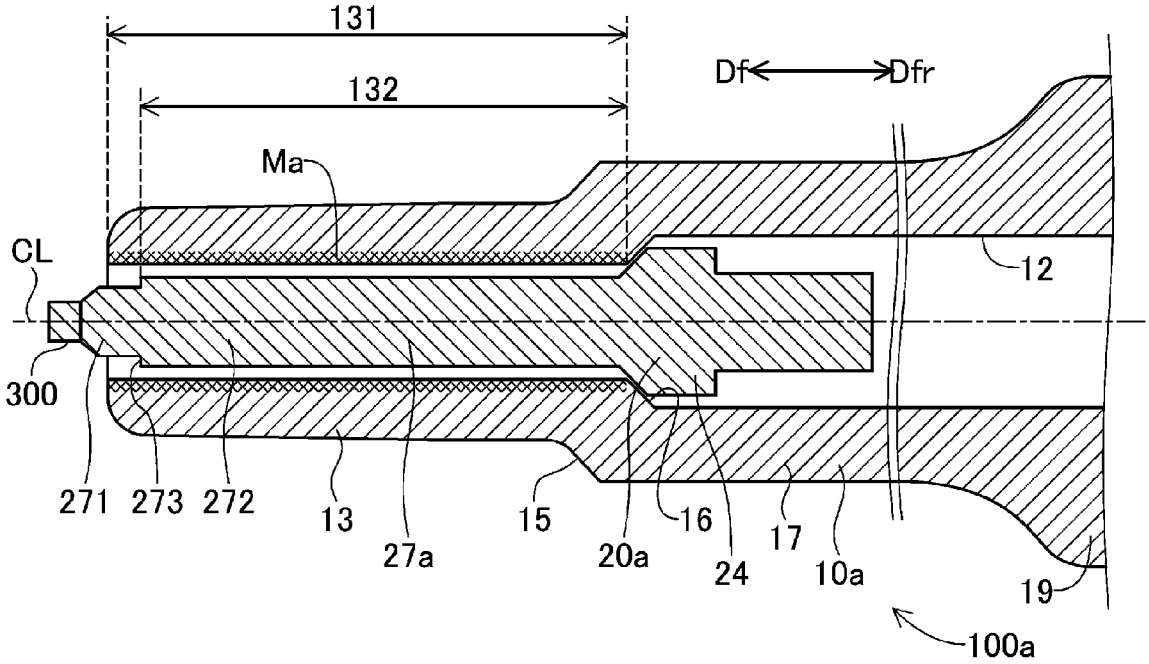
FIG. 8 is a partially sectional view of a spark plug according to another embodiment.

FIG. 8 is a partially sectional view of a spark plug according to another embodiment. FIG. 8 is sectional view including a central electrode 20*a* and a portion of an insulator 10*a* including an end in the distal direction Df. This sectional view is a sectional view obtained by sectioning a member along the plane including the central axis CL. The spark plug is different from the spark plug 100 according to the first embodiment illustrated in FIG. 1 and FIG. 7 at two points. The first difference is that a mullite portion Ma of an insulator 10*a* is disposed at a position different from that of the mullite portion M illustrated in FIG. 7. The insulator 10*a* has the same shape as the insulator 10 illustrated in FIG. 7. Hereinbelow, components of the insulator 10*a* are denoted with the same reference symbols as those of the corresponding components of the insulator 10 illustrated in FIG. 7. The second difference is that, at the normal temperature (specifically, 20 degrees Celsius), the outer diameter of a first portion 271 including the distal end of the central electrode 20*a* is smaller than the outer diameter of a second portion 272 connected to the proximal end of the first portion 271. In this embodiment, the first portion 271 includes a second tip 300 and a portion of a shank portion 27*a* extending toward the end in the distal direction Df. The second portion 272 is the remaining portion of the shank portion 27*a*. The shank portion 27*a* is a portion corresponding to the shank portion 27 of the central electrode 20 illustrated in FIG. 1. Other components of the central electrode 20*a* are the same as the corresponding components of the central electrode 20 illustrated in FIG. 1. Other components of a spark plug 100*a* are the same as the corresponding components of the spark plug 100 illustrated in FIG. 1 and FIG. 7 (the same components are denoted with the same reference symbols and are not described). FIG. 8 does not include illustrations of components 60, 70, and 80 inside the through hole 12 of the insulator 10*a* and the internal structure of the central electrode 20*a*.

FIG. 8 illustrates a first portion 131 of the insulator 10*a*. The first portion 131 is an area extending toward the end in the distal direction Df from the portion having the largest outer diameter (flange portion 19, here), including a distal end of the insulator 10*a*, and having a uniform inner diameter (also referred to as a "uniform-diameter portion 131"). In the embodiment illustrated in FIG. 8, the uniform-diameter portion 131 represents the entirety of a portion extending toward the end of the insulator 10*a* in the distal direction Df from the end of the tapered inner-diameter portion 16 in the distal direction Df. The mullite portion Ma is formed over the entirety of the inner circumferential surface of the uniform-diameter portion 131. Other portion of the surface of the insulator 10*a* does not contain mullite. The insulator 10*a* having this configuration can be manufactured by the procedure illustrated in FIG. 2. In S120 illustrated in FIG. 2, the mold lubricant Mx containing $S_iO_2$ is applied to an area forming the mullite portion Ma illustrated in FIG. 8 (that is, the shaping surface).

Typically, the distal portion of an insulator accommodates the central electrode. Particularly, when an insulator includes a uniform-diameter portion, extending in the proximal direction Dfr from the end in the distal direction Df and having a uniform inner diameter, at least part of the uniform-diameter portion accommodates the central electrode. Thus, when at least part of the inner circumferential surface of the uniform-diameter portion contains mullite, the insulator is prevented from being broken as a result of the inner circumferential surface of the uniform-diameter portion coming into contact with the central electrode. Thus, the insulator is rendered less breakable without impairing its voltage endurance. In the embodiment illustrated in FIG. 8, the mullite portion Ma is formed over the entirety of the inner circumferential surface of the uniform-diameter portion 131. Thus, breakage of the insulator 10*a* is appropriately avoidable. The mullite portion Ma may be formed on only part of the inner circumferential surface of the uniform-diameter portion 131. In this case, the inner circumferential surface at a portion of the uniform-diameter portion 131 including the end in the distal direction Df preferably contains mullite.

In the embodiment illustrated in FIG. 8, a joint portion 273 between the first portion 271 and the second portion 272 of the central electrode 20*a* is disposed inside the through hole 12. The first portion 271 is more likely to have a higher temperature than the temperature of the second portion 272 since the first portion 271 is located closer to a gap (gap g in FIG. 1) between itself and the ground electrode 30 than the second portion 272. If the first portion 271 would include a portion having an outer diameter the same as the outer diameter of the second portion 272, the outer diameter of the first portion 271 could be expanded by thermal expansion beyond the outer diameter of the second portion 272. In the embodiment illustrated in FIG. 8, however, the outer diameter of the first portion 271 is smaller than the outer diameter of the second portion 272. Thus, the outer diameter of the first portion 271 is prevented from being excessively increased, that is, the first portion 271 is prevented from coming into contact with the inner circumferential surface of the insulator 10*a* even when the temperature of the first portion 271 exceeds the temperature of the second portion 272. Thus, breakage of the insulator 10*a* is appropriately avoidable.

When the central electrode 20*a* includes the first portion 271 and the second portion 272, having a larger outer diameter than that of the first portion 271, at least part of the inner circumferential surface of the insulator 10*a* accommodating the second portion 272 of the central electrode 20*a* preferably contains mullite. For example, a second portion 132 of the insulator 10*a* in FIG. 8 is a portion of the uniform-diameter portion 131 of the insulator 10*a* that accommodates the second portion 272 of the central electrode 20*a*. The inner circumferential surface of the second portion 132 of the insulator 10*a* contains mullite. Thus, when the outer diameter of the second portion 272 of the central electrode 20*a* is expanded by thermal expansion, the second portion 272 is prevented from coming into contact with the inner circumferential surface of the insulator 10*a*. Thus, breakage of the insulator 10*a* is appropriately avoidable.

In the embodiment illustrated in FIG. 8, electrodes having configurations different from that of the central electrode 20*a* are usable as the central electrode. In any case, as long as at least part of the inner circumferential surface of the uniform-diameter portion of an insulator contains mullite, the insulator is rendered less breakable without impairing its voltage endurance.

The central electrode 20*a* illustrated in FIG. 8 is applicable to the embodiment illustrated in FIG. 1. Also in this case, breakage of the insulator 10 due to thermal expansion of the first portion 271 is avoidable.

C. Third Embodiment

Figure 9:
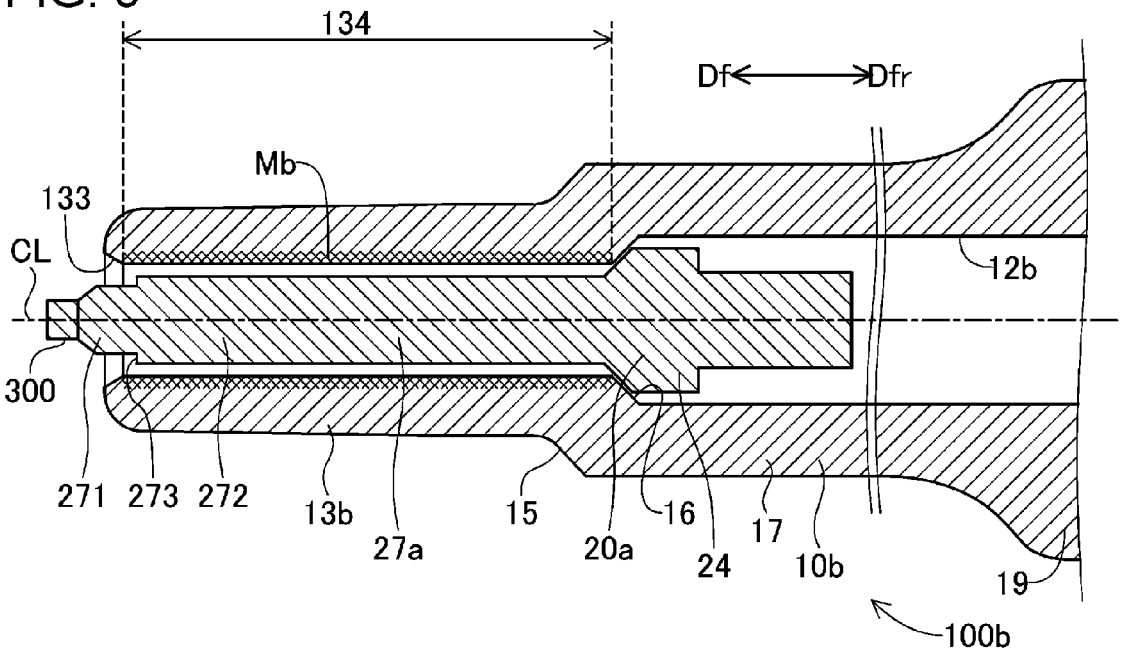
FIG. 9 is a partially sectional view of a spark plug according to another embodiment.

FIG. 9 is a partially sectional view of a spark plug according to another embodiment. FIG. 9 is a sectional view including the central electrode 20*a* and a portion of an insulator 10*b* including the end in the distal direction Df. This sectional view is a sectional view obtained by sectioning a member along the plane including the central axis CL. The only difference between the spark plug and the spark plug 100*a* according to the second embodiment illustrated in FIG. 8 is that an insulator 10*b* includes a chamfered portion 133 at the distal end of the inner circumference of the insulator 10*b*. The chamfered portion 133 is a portion in which the inner diameter decreases in the proximal direction Dfr. Mullite is not contained in the inner circumferential surface of the chamfered portion 133. Other components of the insulator 10*b* are the same as the corresponding components of the insulator 10*a* illustrated in FIG. 8. Other components of a spark plug 100*b* are the same as the corresponding components of the spark plug 100*a* illustrated in FIG. 8. The same components are denoted with the same reference symbols and not described below. FIG. 9 does not include illustrations of components 60, 70, and 80 inside a through hole 12*b* of the insulator 10*b* and the inside structure of the central electrode 20*a*.

FIG. 9 illustrates a specific portion 134 of the insulator 10*b*. The specific portion 134 is a portion obtained by excluding the chamfered portion 133 (FIG. 9) from the portion equivalent to the uniform-diameter portion 131 in FIG. 8. A mullite portion Mb is formed over the entirety of the inner circumferential surface of the specific portion 134. The surface of other portions of the insulator 10*b* does not contain mullite. This insulator 10*b* can be manufactured in accordance with the procedure illustrated in FIG. 2. In S120 in FIG. 2, a stick member having a shaping surface that shapes the inner circumferential surface of the chamfered portion 133 is prepared. The mold lubricant Mx containing $S_iO_2$ is applied to the area (that is, a shaping surface) over which the mullite portion Mb illustrated in FIG. 9 is formed.

When an insulator includes, at its distal end, a chamfered portion at which its inner diameter decreases in the proximal direction Dfr, an area extending toward the end in the proximal direction Dfr from the chamfered portion typically includes a portion having an inner diameter smaller than or equal to the minimum inner diameter of the chamfered portion (for example, the specific portion 134 in FIG. 9). Thus, when at least part of the inner circumferential surface of the insulator in an area extending toward the end in the proximal direction Dfr from the chamfered portion contains mullite, an insulator is less likely to be broken as a result of the inner circumferential surface of the insulator in an area extending toward the end in the proximal direction Dfr from the chamfered portion coming into contact with a member (such as a central electrode) disposed in a through hole. In the embodiment illustrated in FIG. 9, the mullite portion Mb is formed over the entirety of the inner circumferential surface of the specific portion 134. Thus, breakage of the insulator 10*b* is appropriately avoidable.

Typically, at least part of the inner circumferential surface in an area of the insulator 10*b* extending toward the end in the distal direction Df from the largest-outer-diameter portion (the flange portion 19, here) and extending toward the end in the proximal direction Dfr from the chamfered portion preferably contains mullite. For example, the mullite portion Mb illustrated in FIG. 9 may be formed at a portion on the inner circumferential surface of the specific portion 134. In this case, the inner circumferential surface of a portion of the specific portion 134 including an end in the distal direction Df preferably contains mullite. In either case, preferably, at least part of the inner circumferential surface at a portion having an inner diameter smaller than or equal to the minimum inner diameter of the chamfered portion contains mullite. This configuration appropriately renders breakage of the insulator 10*b* avoidable.

D. Fourth Embodiment

Figure 10:
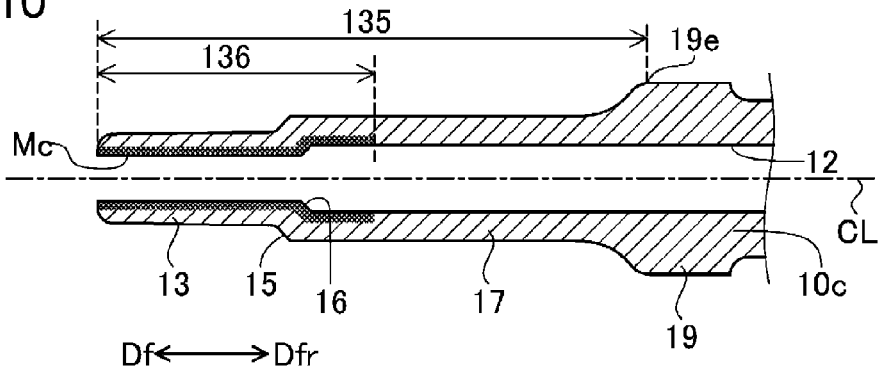
FIG. 10 is a partially sectional view of a spark plug insulator according to another embodiment.

FIG. 10 is a partially sectional view of a spark plug insulator according to another embodiment. FIG. 10 is a sectional view of a portion including the end of an insulator 10*c* in the distal direction Df. This sectional view is a sectional view obtained by sectioning a member along the plane including the central axis CL. The only difference between the insulator and the insulator 10 illustrated in FIG. 1 and FIG. 7 is that a mullite portion Mc is located at a position different from that of the mullite portion M illustrated in FIG. 7. The insulator 10*c* has the same shape as that of the insulator 10 illustrated in FIG. 7. Hereinbelow, components of the insulator 10*c* are denoted with the same reference symbols as those of the corresponding components of the insulator 10 illustrated in FIG. 7. The insulator 10*c* is usable instead of the insulator 10 illustrated in FIG. 1, the insulator 10*a* illustrated in FIG. 8, and the insulator 10*b* illustrated in FIG. 9.

FIG. 10 illustrates a distal portion 135 of the insulator 10*c* and a half 136 (referred to as "a front half 136") of the distal portion 135 in the distal direction Df. The distal portion 135 is an area of the insulator 10*c* extending toward the end in the distal direction Df from the portion having the largest outer diameter (flange portion 19, here). Specifically, the distal portion 135 is an area extending toward the end in the distal direction Df from an end 19*e* of the flange portion 19 in the distal direction Df, that is, from an end 19*e* of a portion having the largest outer diameter in the distal direction Df. The length of the front half 136 parallel to the central axis CL is half the length of the distal portion 135 parallel to the central axis CL.

As described above, the distal portion 135 is more likely to have a high temperature than an area extending toward the end in the proximal direction Dfr from the flange portion 19. The front half 136 of the distal portion 135, which is a half located toward the end in the distal direction Df, is more likely to have a high temperature than the other half of the distal portion 135 located toward the end in the proximal direction Dfr. Thus, when at least part of the inner circumferential surface of the front half 136 contains mullite, the insulator is rendered less breakable without impairing its voltage endurance. In the embodiment illustrated in FIG. 10, the mullite portion Mc is formed over the entirety of the inner circumferential surface of the front half 136. Thus, breakage of the insulator 10*c* is appropriately avoidable. The mullite portion Mc may be formed on only part of the inner circumferential surface of the front half 136. In this case, preferably, the inner circumferential surface at a portion of the front half 136 including an end in the distal direction Df contains mullite.

Although not described in detail, the mullite portions M, Ma, and Mb according to the embodiments illustrated in FIG. 7, FIG. 8, and FIG. 9 each cover the inner circumferential surface in a distal half of an area extending toward the distal end from a portion (flange portion 19, here) of the insulator 10, 10*a*, or 10*b* having the largest outer diameter. Thus, breakage of the insulator is appropriately avoidable.

Instead of the shape illustrated in FIG. 7, FIG. 8, FIG. 9, and FIG. 10, the insulator may have any of other shapes. In any case, preferably, at least part of the inner circumferential surface in a distal half of an area extending toward the distal end from a portion having the largest outer diameter contains mullite. Instead of the inner circumferential surface of such a portion containing mullite, the inner circumferential surface of another portion may contain mullite.

E. Thickness of Distal Portion of Insulator

Figure 11:
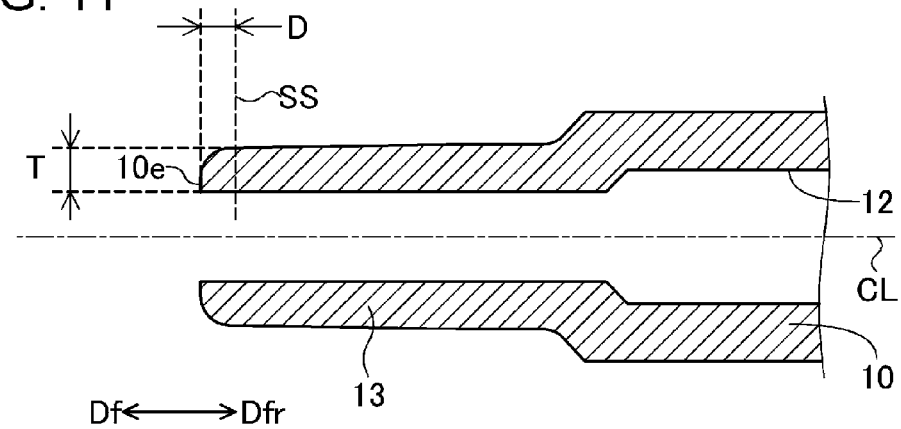
FIG. 11 is a sectional view of a distal portion of an insulator to show the thickness of the distal portion.

FIG. 11 is a sectional view of a distal portion of an insulator to show the thickness of the distal portion. This sectional view is a sectional view obtained by sectioning the insulator along the plane including the central axis CL. FIG. 11 illustrates the insulator 10 (FIG. 7) as an example of an insulator.

A reference plane SS in FIG. 11 is a plane orthogonal to the central axis CL and located closer to the end in the proximal direction Dfr from a distal end 10*e* of the insulator 10. The distance D is a distance between the distal end 10*e* of the insulator 10 and the reference plane SS and parallel to the central axis CL. A thickness T is a thickness of the insulator 10 in the radial direction in the reference plane SS, that is, a distance in the radial direction orthogonal to the central axis CL between the inner circumferential surface and the outer circumferential surface of the insulator 10. The thickness T thus represents a thickness of the insulator 10 in the radial direction at a position the distance D away from the distal end 10*e* in the proximal direction Dfr, parallel to the central axis CL. The thickness T to which the distance D corresponds can be similarly specified in an insulator (such as insulators 10*a*, 10*b*, and 10*c* illustrated in FIG. 8, FIG. 9, and FIG. 10) having a configuration different from that of the insulator 10 illustrated in FIG. 7.

The diameter of a spark plug is reduced in some cases for the purpose of, for example, an enhancement of design flexibility of an internal combustion engine. The reduction of the diameter of a spark plug involves reduction of the diameter of an insulator. Thus, the thickness T of the insulator is reduced. When having a small thickness T, the insulator is likely to have low mechanical strength. As described in each of the above-described embodiments, preferably, at least part of the inner circumferential surface of the insulator in an area extending toward the end in the distal direction Df from a portion having the largest outer diameter (such as the flange portion 19 illustrated in FIG. 1 and FIG. 7) contains mullite. This configuration renders the insulator less breakable without impairing its voltage endurance even though the insulator has a small thickness T. For example, a thickness of smaller than or equal to 1 mm is usable as the thickness T for the distance D of 5 mm. To render the insulator less breakable, the thickness T is preferably larger than or equal to 0.5 mm.

F. Modified Examples (1) Instead of the configuration of each embodiment described above, the insulator may have any of other configurations. For example, the inner diameter defined by the inner circumferential surface at a portion containing mullite may vary by position in a direction parallel to the central axis CL. Alternatively, the inner diameter defined by the inner circumferential surface at a portion not containing mullite may vary by position in a direction parallel to the central axis CL.

An example usable as the inner circumferential surface of an insulator is the surface of the insulator on the inner side in the radial direction between an end in the distal direction Df to an end in the proximal direction Dfr. An example usable as the outer circumferential surface of an insulator is the surface of the insulator on the outer side in the radial direction between an end in the distal direction Df and an end in the proximal direction Dfr.

(2) Instead of the method described in FIG. 2, any of other methods are usable as the method for manufacturing an insulator. For example, after an unfired compact not containing mullite is formed using a mold, a paste containing $S_iO_2$ may be applied to the inner circumferential surface of the compact.

(3) Instead of the configuration of each embodiment described above, a spark plug may have any of other configurations. For example, the central electrode 20 illustrated in FIG. 1 may be applied to any of the embodiments illustrated in FIG. 8, FIG. 9, and FIG. 10. Alternatively, the central electrode 20*a* illustrated in FIG. 8 may be applied to any of the embodiments illustrated in FIG. 1, FIG. 7, FIG. 9, and FIG. 10. At least one of the first tip 200 and the second tip 300 may be omitted. An integrated compact made of a high melting point material such as tungsten may be used as an example of the central electrode, instead. An integrated compact made of a high melting point material such as tungsten may be used as an example of the ground electrode.

Thus far, the present invention has been described on the basis of the embodiments and modified examples. However, the embodiments of the present invention are provided for easy understanding of the present invention and not intended to limit the invention. The present invention can be modified or improved without departing from the gist and the scope of claims of the invention and the present invention includes equivalents of the modification or improvement.

REFERENCE SIGNS LIST

5 gasket
6 first proximal gasket
7 second proximal gasket
8 distal gasket
9 talc
10, 10*a*, 10*b*, 10*c* insulator (ceramic insulator)
10*e* distal end
10*i* stick member
10*x* compact
11 second tapered outer-diameter portion
12, 12*b*, 12*x* through hole (axial hole)
13 leg portion
13*i* portion
13*x* portion
14*i* outer circumferential surface
15 first tapered outer-diameter portion
16 tapered inner-diameter portion
17 distal trunk portion
18 proximal trunk portion
19 flange portion
19*e* end
20, 20*a* central electrode
21 outer layer
22 core portion
23 head portion
24 flange portion
25 leg portion
27, 27*a* shank portion
30 ground electrode
31 distal portion
35 outer layer
36 core portion
37 shank portion
40 metal terminal
50 metal shell
51 tool fastening portion
52 thread
53 crimped portion
54 seat portion
55 trunk portion
56 tapered inner-diameter portion
57 distal surface
58 deformed portion
59 through hole
60 first sealant
80 resistor
100, 100*a*, 100*b* second sealant
100, 100*a*, 100*b* spark plug
131 uniform-diameter portion (first portion)
132 second portion
133 chamfered portion
134 fourth portion
135 distal portion
136 front half
200 first tip
271 first portion
272 second portion
273 joint portion
300 second tip
941 molding press
942 cavity
943 inner rubber mold
944 outer rubber mold
945 molding press body
945*a* liquid flow path
946 bottom cover
947 lower holder
g gap
M, Ma, Mb, Mc mullite portion
D distance
CL central axis (axial line)
SS reference plane
CV cavity
Ps sealant distal end position
Mx mold lubricant
Df distal direction
Dfr proximal direction

What is claimed is:

1. A tube-shaped spark plug insulator having a through hole extending in a direction of an axial line, the insulator containing alumina, as a main component, and mullite, at at least part of the insulator, wherein the mullite is contained in only an inner circumferential surface side of the tube-shaped insulator and in at least part of the inner circumferential surface of the insulator in an area extending toward a distal end from a portion having a largest outer diameter.

2. The spark plug insulator according to claim 1, comprising:

a uniform-diameter portion having a uniform inner diameter and extending from a distal end of the insulator in the direction of the axial line on an inner circumference in the area extending toward the distal end from the portion having the largest outer diameter, wherein at least part of an inner circumferential surface of the uniform-diameter portion contains mullite.

3. The spark plug insulator according to claim 1, wherein the insulator includes a chamfered portion at which an inner diameter of the insulator decreases toward a proximal end, the chamfered portion being disposed at a distal portion of the insulator on an inner circumference of the insulator, and wherein at least part of an inner circumferential surface in an area extending toward the proximal end from the chamfered portion contains mullite.

4. The spark plug insulator according to claim 1, wherein at least part of an inner circumferential surface in a distal half of the area extending toward the distal end from the portion having the largest outer diameter contains mullite.

5. A spark plug, comprising:

the spark plug insulator according to claim 1;

a central electrode disposed in a distal portion of the through hole;

a metal shell disposed around the insulator; and a ground electrode joined to the metal shell and facing a distal portion of the central electrode with a gap interposed therebetween.

* * * * *